US009138984B2

(12) United States Patent
Noguchi et al.

(10) Patent No.: US 9,138,984 B2
(45) Date of Patent: Sep. 22, 2015

(54) APPARATUS CAPABLE OF EXECUTING PRINTING ON BOTH SURFACES OF A CONTINUOUS SHEET AND PRINTING CONTROL METHOD FOR EXECUTING PRINTING ON BOTH SURFACES OF A CONTINUOUS SHEET

(71) Applicant: CANON KABUSHIKI KAISHA, Tokyo (JP)

(72) Inventors: Takayoshi Noguchi, Tokyo (JP); Kazunari Shishido, Yokohama (JP); Sho Nakamura, Yokohama (JP); Atsushi Hirahara, Kawasaki (JP); Tatsuhiko Tomita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/973,718

(22) Filed: Aug. 22, 2013

(65) Prior Publication Data

US 2013/0336698 A1 Dec. 19, 2013

Related U.S. Application Data

(63) Continuation of application No. 13/050,205, filed on Mar. 17, 2011, now Pat. No. 8,540,441.

(30) Foreign Application Priority Data

Mar. 24, 2010 (JP) ..... 2010-068289
Mar. 24, 2010 (JP) ..... 2010-068290

(51) Int. Cl.
*B41J 3/60* (2006.01)
*B41F 33/16* (2006.01)
(Continued)

(52) U.S. Cl.
CPC ..... *B41F 33/16* (2013.01); *B41J 3/60* (2013.01);*B41J 11/70* (2013.01); *B41J 29/393* (2013.01); *G03G 15/237* (2013.01); *G03G 15/5012* (2013.01); *G03G 2215/00126* (2013.01)

(58) Field of Classification Search
USPC ..... 399/97, 384, 401; 400/76, 188, 614
See application file for complete search history.

(56) References Cited

U.S. PATENT DOCUMENTS 4,641,954 A 2/1987 Miyata
4,881,132 A 11/1989 Lajos
(Continued)

FOREIGN PATENT DOCUMENTS

JP 06-246987 A 9/1994
JP 06-262785 A 9/1994
(Continued)

*Primary Examiner* — Daniel J Colilla
*Assistant Examiner* — Justin Olamit
(74) *Attorney, Agent, or Firm* — Canon USA, Inc. IP Division

(57) ABSTRACT

An apparatus includes an input unit and a printing control unit to cause a printing unit to execute printing on a continuous sheet. The input unit inputs an instruction for printing by the printing unit. The printing control unit causes the printing unit to execute printing according to a second job subsequent to printing on a first surface of the continuous sheet based on a first job, wherein the instruction input by the input unit may include a first job that is a two-sided printing and a second job that is a one-sided printing, or a first job that is a one-sided printing and a second job that is a two-sided printing. A supplying unit is controlled to supply the printed continuous sheet to a reversal unit which reverses the continuous sheet to execute printing on a second surface after executing printing on a first surface of the continuous sheet.

17 Claims, 5 Drawing Sheets

(51) Int. Cl.

| | |
|---|---|
| ***B41J 29/393*** | (2006.01) |
| ***B41J 11/70*** | (2006.01) |
| ***G03G 15/23*** | (2006.01) |
| ***G03G 15/00*** | (2006.01) |

(56) References Cited

U.S. PATENT DOCUMENTS

| | | | | |
|---|---|---|---|---|
| 5,479,856 | A | 1/1996 | Wirz | |
| 5,812,901 | A | 9/1998 | Morikawa | |
| 5,868,069 | A | 2/1999 | Khalid | |
| 5,970,304 | A | 10/1999 | Stemmle | |
| 5,987,300 | A | 11/1999 | Mori | |
| 6,075,925 | A * | 6/2000 | Downing et al. | 358/1.1 |
| 6,209,454 | B1 | 4/2001 | Christmann | |
| 6,393,252 | B1 | 5/2002 | Yamagishi | |
| 6,401,608 | B1 | 6/2002 | Lyon | |
| 6,718,872 | B2 | 4/2004 | Kanno | |
| 6,745,688 | B1 | 6/2004 | Lemelin | |
| 6,786,149 | B1 | 9/2004 | Lomoine | |
| 7,031,014 | B2 | 4/2006 | Ohwa | |
| 7,188,564 | B2 | 3/2007 | Ashikagaya | |
| 7,196,809 | B2 | 3/2007 | Ouchi | |
| 7,401,914 | B2 | 7/2008 | Yokoi | |
| 7,599,094 | B2 | 10/2009 | Sellers | |
| 7,676,191 | B2 | 3/2010 | Furst | |
| 7,725,071 | B2 | 5/2010 | Izuchi | |
| 7,882,781 | B2 | 2/2011 | Takahashi | |
| 8,011,611 | B2 * | 9/2011 | Yoshimaru et al. | 242/421 |
| 8,540,441 | B2 | 9/2013 | Noguchi | |
| 8,641,305 | B2 | 2/2014 | Yasuzaki | |
| 2001/0020973 | A1 | 9/2001 | Akada | |
| 2002/0005888 | A1 | 1/2002 | Obata | |
| 2002/0112285 | A1 | 8/2002 | Minnick | |
| 2002/0191162 | A1 | 12/2002 | Morita | |
| 2004/0246325 | A1 | 12/2004 | Sekiya | |
| 2005/0046658 | A1 | 3/2005 | Kojima | |
| 2005/0076798 | A1 | 4/2005 | Sato | |
| 2005/0163550 | A1 | 7/2005 | Gobbak | |
| 2005/0280685 | A1 | 12/2005 | Yokoi | |
| 2006/0107855 | A1 | 5/2006 | Hatayama | |
| 2006/0203306 | A1 | 9/2006 | Hoshi | |
| 2006/0283343 | A1 | 12/2006 | Koyama | |
| 2007/0122225 | A1 | 5/2007 | Izuchi | |
| 2008/0159800 | A1 | 7/2008 | Wada | |
| 2008/0178754 | A1 | 7/2008 | Ohdaira | |
| 2008/0192281 | A1 * | 8/2008 | Hagiwara | 358/1.15 |
| 2008/0199235 | A1 | 8/2008 | Shoji | |
| 2009/0060610 | A1 | 3/2009 | Matsuhashi | |
| 2009/0225364 | A1 | 9/2009 | Sato | |
| 2009/0237687 | A1 | 9/2009 | Takata | |
| 2009/0244177 | A1 | 10/2009 | Tatsumi | |
| 2010/0085591 | A1 | 4/2010 | Arai | |
| 2010/0310268 | A1 | 12/2010 | Obata | |
| 2010/0321434 | A1 | 12/2010 | Baba | |
| 2011/0002721 | A1 | 1/2011 | Yamazaki | |
| 2011/0043586 | A1 | 2/2011 | Silverbrook | |
| 2011/0211009 | A1 | 9/2011 | Fujinaga | |
| 2011/0211857 | A1 | 9/2011 | Mikami | |
| 2011/0211888 | A1 | 9/2011 | Fujinaga | |
| 2011/0211892 | A1 | 9/2011 | Yasuzaki | |
| 2011/0211893 | A1 | 9/2011 | Shishido | |
| 2011/0236105 | A1 | 9/2011 | Noguchi | |
| 2011/0236107 | A1 | 9/2011 | Sugiura | |
| 2011/0298860 | A1 | 12/2011 | Yoshida | |
| 2012/0050378 | A1 | 3/2012 | Kido | |
| 2014/0119751 | A1 | 5/2014 | Yasuzaki | |

FOREIGN PATENT DOCUMENTS

| | | | |
|---|---|---|---|
| JP | 10-339975 | A | 12/1998 |
| JP | 11-249346 | A | 9/1999 |
| JP | 2000-261595 | A | 9/2000 |
| JP | 2000-321827 | A | 11/2000 |
| JP | 2000-353068 | A | 12/2000 |
| JP | 2003-149931 | A | 5/2003 |
| JP | 2004-066761 | A | 3/2004 |
| JP | 2004-167932 | A | 6/2004 |
| JP | 2004-209808 | A | 7/2004 |
| JP | 2004-254047 | A | 9/2004 |
| JP | 2005-067757 | A | 3/2005 |
| JP | 2005-073036 | A | 3/2005 |
| JP | 2005-208124 | A | 8/2005 |
| JP | 2006-209513 | A | 8/2006 |
| JP | 2006-321167 | A | 11/2006 |
| JP | 2007-124040 | A | 5/2007 |
| JP | 2007-183894 | A | 7/2007 |
| JP | 2008-108124 | A | 5/2008 |
| JP | 2008-126530 | A | 6/2008 |
| JP | 2008-162206 | A | 7/2008 |
| JP | 2008-173937 | A | 7/2008 |
| JP | 2008-177817 | A | 7/2008 |
| JP | 2009-066815 | A | 4/2009 |
| JP | 2009-154540 | A | 7/2009 |
| WO | 2009133659 | A1 | 11/2009 |

* cited by examiner

APPARATUS CAPABLE OF EXECUTING PRINTING ON BOTH SURFACES OF A CONTINUOUS SHEET AND PRINTING CONTROL METHOD FOR EXECUTING PRINTING ON BOTH SURFACES OF A CONTINUOUS SHEET

CROSS REFERENCE TO RELATED APPLICATIONS

The present application is a continuation of U.S. patent application Ser. No. 13/050205, filed on Mar. 17, 2011, which claims priority from Japanese Patent Application No. 2010-068289, filed Mar. 24, 2010, and from Japanese Patent Application No. 2010-068290, filed Mar. 24, 2010, all of which are hereby incorporated by reference herein in their entirety.

BACKGROUND OF THE INVENTION

1. Field of the Invention

The present invention relates to a printing control apparatus and a printing control method configured to execute printing on a continuous sheet.

2. Description of the Related Art

In printing an image on both surfaces of a continuous sheet, such as a roll sheet, a conventional method, as discussed in Japanese Patent Application Laid-Open No. 11-249346, executes printing on one surface of a continuous sheet that has been conveyed into a printing unit, cuts the continuous sheet, and temporarily winds up the cut continuous sheet. The conventional method then conveys the continuous sheet again into the printing unit to execute printing on the other surface.

In order to execute efficient printing, the printing apparatus of this type serially executes the printing on one surface of the sheet for a plurality of pages and goes on to printing on the other surface after completing printing of all the pages on one surface. By executing printing on both surfaces of a sheet, efficient two-sided printing can be executed.

However, in executing two-sided printing in the above-described manner, because printing is continuously executed on the same sheet surface, a preceding two-sided print job cannot be appropriately completed if another print job is input as an interruption print job during printing the two-sided print job. More specifically, if an interruption print job is to be executed during printing on a first surface of a two-sided print job, a sheet used in the preceding print job may be discharged before printing on its second surface is executed.

On the other hand, if the interruption print job is enqueued until the preceding print job is completely executed, the interruption print job may not be completed within appropriate time because it is necessary to re-feed the continuous sheet.

SUMMARY OF THE INVENTION

According to an aspect of the present invention, an apparatus configured to cause a printing unit to execute printing on a continuous sheet includes an input unit configured to input an instruction for printing by the printing unit. and a printing control unit configured to cause the printing unit to execute, in a case where a first job to be executed based on the instruction input by the input unit is a two-sided printing and a second job to be executed based on the instruction input by the input unit is a one-sided printing, or in a case where a first job to be executed based on the instruction input by the input unit is a one-sided printing and a second job to be executed based on the instruction input by the input unit is a two-sided printing, the printing according to the second job subsequent to the printing on a first surface of the continuous sheet based on the first job, and configured to cause a supplying unit to supply the printed continuous sheet to a reversal unit which reverses the continuous sheet to execute printing on a second surface of the continuous sheet after executing printing on a first surface of the continuous sheet in executing printing by the printing unit on both surfaces of the continuous sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

DESCRIPTION OF THE EMBODIMENTS

Various exemplary embodiments, features, and aspects of the invention will be described in detail below with reference to the drawings. The relative arrangement of components of an apparatus and a shape of the apparatus according to an exemplary embodiment are mere examples and the present invention is not limited to those described below.

Figure 1:
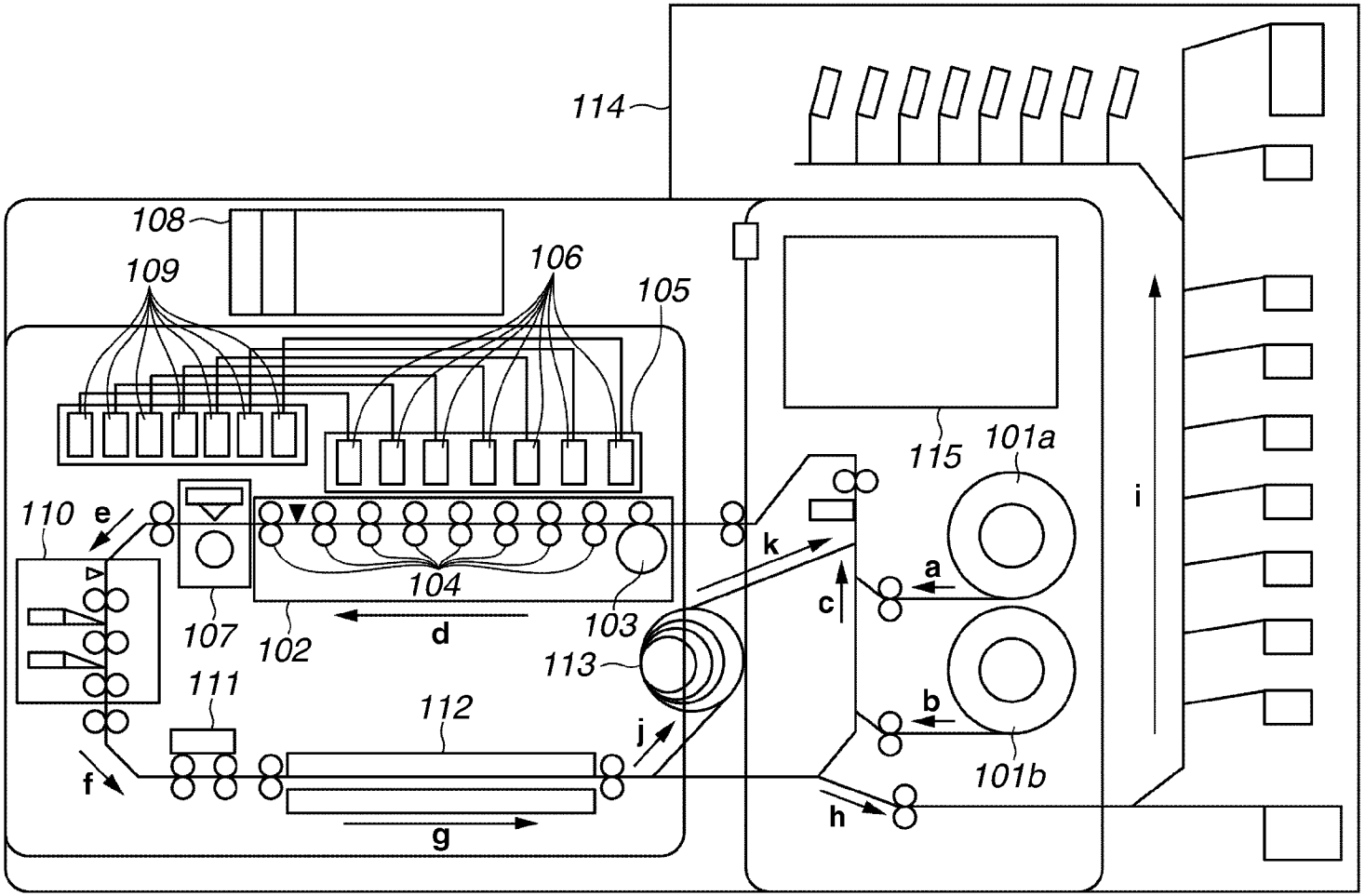
FIG. 1 illustrates an exemplary configuration of an image forming apparatus according to an exemplary embodiment.

FIG. 1 illustrates an exemplary configuration of an image forming apparatus, which is an example of a printing control apparatus according to an exemplary embodiment. The image forming apparatus illustrated in FIG. 1 includes a printing function only, which is a function for printing data received from an external apparatus. However, the present invention is not limited to this. More specifically, an apparatus including a reading unit for reading an image of a document in addition to the printing function and functioning as a copying machine can implement the image forming apparatus according to an exemplary embodiment. Furthermore, a multifunction peripheral (MFP) having other functions in addition to those described above can implement the image forming apparatus according to an exemplary embodiment.

Moreover, in the following description, it is supposed that a roll sheet is used as a recording material (a recording medium or a recording sheet) for printing. The roll sheet is used as an example of a continuous sheet. However, the present invention is not limited to this. More specifically, a long continuous sheet, even if it is not a roll sheet, can be used if printing of a job including a plurality of pages can be executed on the same surface of the sheet without cutting the sheet.

For a method of cutting the continuous sheet, the image forming apparatus can automatically cut the continuous sheet. Alternatively, the continuous sheet can be cut according to a user instruction for cutting the sheet, which is manually input by the user. The material of the recording sheet is not limited to paper. More specifically, various types of recording materials can be used if an image can be printed thereon.

Furthermore, the present invention is not limited to the image forming apparatus capable of execute printing on a continuous sheet. More specifically, an image forming apparatus capable of printing on a cut sheet, which is provided by previously cutting a continuous sheet into a cut sheet of a predetermined size, can implement an embodiment.

For the printing method, the present invention is not limited to inkjet type printing of an image that uses an image-printing liquid ink, which will be described in detail below. In other words, a solid ink can be used as a recording agent to be applied onto the recording material. Furthermore, the printing method according to an exemplary embodiment can be implemented by various methods, such as an electrophotographic printing method using a toner, a sublimation printing method, a thermal transfer printing method, or a dot impact printing method.

In addition, the present invention is not limited to color recording that uses a plurality of colors as recording agents. In other words, and embodiment can be implemented by monochromatic recording that uses a black (or gray) recording agent only.

Furthermore, the printing according to an exemplary embodiment is not limited to printing of a visible image. In other words, the printing can include printing of an invisible image or an image that cannot be easily visualized. Furthermore, the printing can be implemented by printing of various printable data or patterns different from a general image, such as a pattern of wiring, a physical pattern used to manufacture apart, or a base sequence of deoxyribonucleic acid (DNA). In other words, an embodiment can be implemented by various types of recording apparatuses capable of executing printing that uses a recording material to which a recording agent can be applied.

In addition, in controlling a printing operation on the image forming apparatus according to an instruction input by an external apparatus connected to the image forming apparatus illustrated in FIG. 1, the external apparatus implements the printing control apparatus.

FIG. 1 is a cross section of the entire image forming apparatus that uses a roll sheet (i.e., a continuous sheet which is continuous and having a length longer than a unit of printing (the length of a page) in the conveyance direction) as a recording material. The image forming apparatus includes the following components 101 through 115, which are provided within one integrated housing. However, alternatively, the components 101 through 115 of the image forming apparatus can be provided separately from one another in a plurality of housings.

A control unit 108 includes a control section having a controller (including a central processing unit (CPU) or a micro processing unit (MPU)), an output device for outputting user interface (UI) information (i.e., a display information generation device or an audio information generation device), and various input/output (I/O) interfaces. The control unit 108 executes various controls on the entire image forming apparatus.

In addition, the image forming apparatus includes two roll sheet storage and feeding units, such as an upper-stage sheet cassette 101*a* and a lower-stage sheet cassette 101*b*. A user of the image forming apparatus sets the roll sheet (hereinafter simply referred to as a "sheet") into a magazine and then sets the magazine onto the image forming apparatus body.

A sheet fed from the upper-stage sheet cassette 101*a* is conveyed in a direction "a" illustrated in FIG. 1. On the other hand, a sheet fed from the lower-stage sheet cassette 101*b* is conveyed in a direction "b" illustrated in FIG. 1. The sheet fed from the upper-stage sheet cassette 101*a* or the lower-stage sheet cassette 101*b* is then conveyed in a direction "c" to reach a conveyance unit 102. During printing, the conveyance unit 102 conveys the sheet in a direction "d" (i.e., in the horizontal direction) via a plurality of rollers 104.

The sheet feeding source can be changed from one sheet cassette to the other by winding the already fed part of the roll sheet back into the cassette and by supplying a new sheet from the cassette in which the sheet to be newly fed has been set. In addition, when a series of print processing is completed, the already fed sheet is wound back into the cassette. After that, when a new print job is received, another sheet is newly fed from the cassette.

In addition, the image forming apparatus includes a head unit 105, which is provided above and facing the conveyance unit 102. The head unit 105 includes printing heads 106 of a plurality of colors (in an exemplary embodiment, seven colors), which are provided independent from one another. More specifically, the printing heads 106 are supported within the head unit 105 along the sheet conveyance direction. In an exemplary embodiment, seven printing heads 106 are used corresponding to seven colors including cyan (C), magenta (M), yellow (Y), light cyan (LC), light magenta (LM), gray (G), and black (K). However, a printing head corresponding to a color other than those described above can be used as the printing head 106. Furthermore, it is not necessary to use all the seven color printing heads 106 to implement an embodiment.

In synchronization with the conveyance of the sheet by the conveyance unit 102, the image forming apparatus causes the printing head 106 to discharge an ink therefrom to form an image on the sheet. The printing head 106 is provided at a location at which an ink discharge target position does not come to the position of the rollers 104.

Instead of forming an image by discharging the ink directly onto the sheet, an image can also be formed by applying the ink onto a surface of an intermediate transfer member and then transferring the ink onto the sheet from the intermediate transfer member. A printing unit according to an exemplary embodiment includes the conveyance unit 102, the head unit 105, and the printing head 106.

Ink tanks 109 respectively store each corresponding color ink independently from one another. The ink is supplied from the ink tank 109 into a sub tank, which is provided corresponding to each color ink, via an ink supply tube. The ink is then supplied from the sub tank to each of the printing heads 106 via another ink supply tube.

A plurality of line heads for each corresponding color (each of the seven colors used in an exemplary embodiment) is arranged as the printing heads 106 in the sheet conveyance direction "d", along which the sheet is conveyed during printing. A line head including an integrated seamless nozzle chip can be used for the line head corresponding to each color. Alternatively, a line head including divided nozzle chips regularly arranged in a straight-line configuration or in a staggered configuration can be used for the line head corresponding to each color. In an exemplary embodiment, a "full multihead" is used, having a plurality of nozzles arranged within a range substantially equivalent to or greater than an width of a printable region of a sheet of a largest size that can be used for printing by the image forming apparatus according to an exemplary embodiment.

For the inkjet type printing method, a printing method that uses a heat generation device, a printing method that uses a piezo element, a printing method that uses an electrostatic element, or a printing method that uses a micro electro mechanical systems (MEMS) element can be used.

The ink is discharged from the nozzles of each head according to input print data at an ink discharge timing determined according to an output signal from a conveyance encoder 103. After the image is formed on the sheet, the sheet is conveyed from the conveyance unit 102 to a scanner unit 107.

The scanner unit 107 optically reads the image or a special pattern printed on the sheet and verifies whether the quality of the printed image is sufficiently high and verifies the status of operation of the image forming apparatus including an ink discharge status. The quality of the printed image can be verified based on a result of verifying the ink discharge status, which can be determined according to a result of reading a pattern used for verifying the status of the head. Alternatively, the quality of the printed image can be verified based on a result of printing, which can be verified according to a result of comparison of the printed image with an original image. Various methods can be appropriately and selectively determined and used for verifying the quality of the printed image.

The sheet is conveyed from around the scanner unit 107 in a direction "e" and is guided into a cutter unit 110. The cutter unit 110 cuts the sheet in the unit of a length equivalent to a predetermined unit of printing. The predetermined unit of printing may differ according to the size of the image to be printed.

For example, if an L-size photograph is to be printed, the length of the sheet in the conveyance direction is 135 mm. If an A4-size sheet is used, the length of the sheet in the sheet conveyance direction is 297 mm. In executing one-sided printing, the cutter unit 110 cuts the sheet in the unit of a page. However, the cutter unit 110 may cut the sheet not in the unit of a page according to the content of an input print job.

On the other hand, in executing two-sided printing, the cutter unit 110 cuts, after images on a first surface of the sheet (i.e., a surface of the sheet to be printed first, in other words, the front surface of the sheet) up to a predetermined sheet length are printed without cutting the sheet in the unit of a page and then an image on a second surface of the sheet (i.e., a surface of the sheet to be printed later, in other words, the back surface of the sheet) is printed, the sheet in the unit of a page.

In executing one-sided printing or in printing on the back surface of the sheet in two-sided printing, the cutter unit 110 can cut the sheet by a cutting method other than cutting the sheet in the unit of one printed image. More specifically, the cutter unit 110 can cut the sheet after the sheet is conveyed by a predetermined sheet length. In this case, another cutting apparatus can be used to allow the user to cut the sheet in the unit of one image (one page image) by a manual operation. If it is necessary to cut the sheet in the sheet width (latitudinal) direction, another cutting apparatus can be used to execute the cutting of the sheet in this direction.

The sheet conveyed from the cutter unit 110 is conveyed within the printing unit in a direction "f" to reach a back-surface printing unit 111. In printing an image only on one surface of the sheet, the back-surface printing unit 111 prints predetermined information on the back surface of the sheet. Information to be printed on the back surface of the sheet includes various information, such as a character, a symbol, or codes corresponding to each image printed on the front surface of the sheet (e.g., an order management number).

If the printing head 106 prints an image of a two-sided print job, the back-surface printing unit 111 prints the above-described information outside an area in which an image is formed by the printing head 106. For the back-surface printing unit 111, a recording agent impression type printing unit, a thermal transfer type printing unit, or an inkjet type printing unit can be used.

After being conveyed through the back-surface printing unit 111, the sheet is further conveyed to a drying unit 112. The drying unit 112 applies heat onto the sheet, which is conveyed through the drying unit 112 in a direction "g" illustrated in FIG. 1 with warm air (warmed gas (air)) to dry up the sheet to which the ink has been applied within short seconds. To dry up the sheet having the image printed thereon, various methods can be used. In other words, the sheet can be dried by blowing cold air thereon, by applying heat by using a heater (not illustrated), by natural drying, i.e., by merely stopping the sheet within the drying unit 112, or by irradiating the sheet with an electromagnetic wave, such as ultraviolet (UV) light.

After being cut in the unit of printing, the sheet is conveyed from the drying unit 112 one by one to be further conveyed in a direction "h" into a sorting unit 114. The sorting unit 114 holds a plurality of trays (in the present exemplary embodiment, eighteen trays). The sorting unit 114 selectively uses a tray onto which the sheet is to be discharged according to the length of the unit of printing. Each tray is assigned with a unique tray number.

While detecting the status of the sheet being conveyed through the sorting unit 114 in a direction "i" and verifying the availability of the tray (i.e., whether the tray has been full of printed and cut sheets stacked thereon) by using a sensor provided on each tray, the sorting unit 114 discharges the sheet onto the tray corresponding to the tray number set for each printed image. The tray that is a cut sheet discharge destination can be determined by designating a specific tray in a print job issue apparatus (host apparatus). Alternatively, the image forming apparatus can arbitrarily designate an available tray as the tray onto which the cut sheet is to be discharged.

One tray can stack a predetermined number of cut printed sheets. If the number of prints to be printed by executing a print job exceeds the predetermined number, the sheets are to be selectively discharged on a plurality of trays. The number, the size, and the type of the sheets that can be discharged on one tray differ according to the size (type) of the tray.

In the example illustrated in FIG. 1, both large-size sheets (i.e., sheets larger than L-size sheets, such as A4-size sheets) and small-size sheets (i.e., L-size sheets) can be discharged onto the trays vertically provided in tandem with one another (hereinafter simply referred to as "large tray (s)"). In addition, onto the trays provided from left to right in the drawing (i.e., the trays provided horizontally in tandem with one another) (hereinafter simply referred to as "small tray(s)"), a small-size sheets (L-size sheets) can be discharged but large-size sheets cannot be discharged. More sheets can be output onto the large tray than onto the small tray.

Furthermore, an exemplary embodiment uses a display device, such as a light-emitting diode (LED), to allow the user to recognize the operation status, such as "sheet being discharged . . . " or "sheet discharge completed". More specifically, a plurality of LEDs, which emits light in mutually different colors, can be provided in the trays to notify the user of various status information about the sheet stacking state of each tray. In this case, the color of the lit LED can indicate a corresponding status. Alternatively, whether the LED is lit or flashing can notify the user of the sheet stacking state of each tray.

A sheet discharge stacking order can be assigned to each of the plurality of trays. In executing a print job, the image forming apparatus serially designates available trays (trays stacking no sheets) as sheet discharge destinations according to the sheet stacking priority order. As a default setting, the large trays have a descending sheet stacking priority order from top to bottom. The small trays have a left-to-right descending sheet stacking priority order. The large trays have a higher sheet stacking priority order than the small trays.

The sheet stacking priority order of the tray located where the user can easily take out the sheet stacked thereon can be previously set high. Furthermore, the sheet stacking priority order can be appropriately changed by a user operation.

The sheet winding unit 113 rotates to wind up the sheet that has not been cut in the unit of a page and has an image printed on its front surface. In executing two-sided printing, the cutter unit 110 at first does not cut the printed sheet having an image printed thereon in the unit of a page until the continuously executed printing of the front surface is completed.

After the image is printed on the front surface of the sheet, the sheet is conveyed through the printing unit in a direction "j" illustrated in FIG. 1 to be wound up by the sheet winding unit 113. After a series of printing of the image on the front surface of the sheet is completed and the sheet having the image on the front surface thereof is wound up by the sheet winding unit 113, the sheet is conveyed again through the printing unit in a direction "k" to enable printing on the other surface of the front surface (i.e., in a state in which the surface facing the printing heads 106 is reversed). By conveying the sheet in the above-described manner, an image can be printed on the back surface of the sheet (the other side of the front surface).

In executing normal one-sided printing, the sheet having an image printed thereon is directly conveyed to the sorting unit 114 without being wound up by the sheet winding unit 113. As described above, in executing two-sided printing, the sheet winding unit 113 winds up the sheet and the sheet is reversed to print an image on the back surface of the sheet. Accordingly, the surface that may face upwards when discharged into the sorting unit 114 in executing one-sided printing differs from that in the case of two-sided printing.

In other words, in executing one-sided printing, because the sheet is not reversed by the sheet winding unit 113 in this case, the sheet having an image of a first page printed thereon is discharged in a state in which the surface of the sheet having the first page image printed thereon faces downwards.

In executing a print job including a plurality of pages, the sheets are serially discharged on the tray starting from the sheet having the first page image printed thereon to sheet corresponding to subsequent pages. In this manner, the sheets are stacked on the tray. The method for discharging the sheets in the above-described manner is referred to as "face-down discharge".

On the other hand, in executing two-sided printing, because the sheet is reversed by the sheet winding unit 113, the sheet having the image of the first page printed thereon is discharged in a state in which the first page image faces upwards. In this case, if a print job that requires the output of a plurality of sheets has been input and executed, the sheets are to be discharged onto the tray starting from the sheet having an image of the last page thereof. Subsequently, following sheets are serially discharged on the sheet in ascending order of the page number. In this manner, the sheets are stacked on the tray in this case to finally discharge the sheet having the image of the first page printed thereon onto the tray. The method for discharging the sheets in the above-described manner is referred to as "face-up discharge".

Alternatively, if it is desired to discharge the sheet on the same surface regardless of one-sided or two-sided printing (i.e., if it is desired to always discharge the sheet by the face-up discharge or the face-down discharge), the order of printing the first surface (in the descending order or the ascending order) can be changed according to the printing method (one-sided printing or two-sided printing).

The user can input various operations via an operation unit 115. In addition, various information can be notified to the user via the operation unit 115. More specifically, the user can confirm the tray onto which the sheet having the image designated by the user and printed thereon has been stacked, by referring to the information displayed on the operation unit 115. Furthermore, the user can also confirm the status of progress of printing for each order, i.e., whether the printing of the image designated by the user has already been completed or not.

In addition, the user can operate the operation unit 115 to confirm various status information about the image forming apparatus, such as the remaining ink amount or the remaining quantity of the sheets. Furthermore, the user can also operate the operation unit 115 to input an instruction for executing a maintenance operation of the image forming apparatus, such as cleaning of the printing head.

Figure 2:
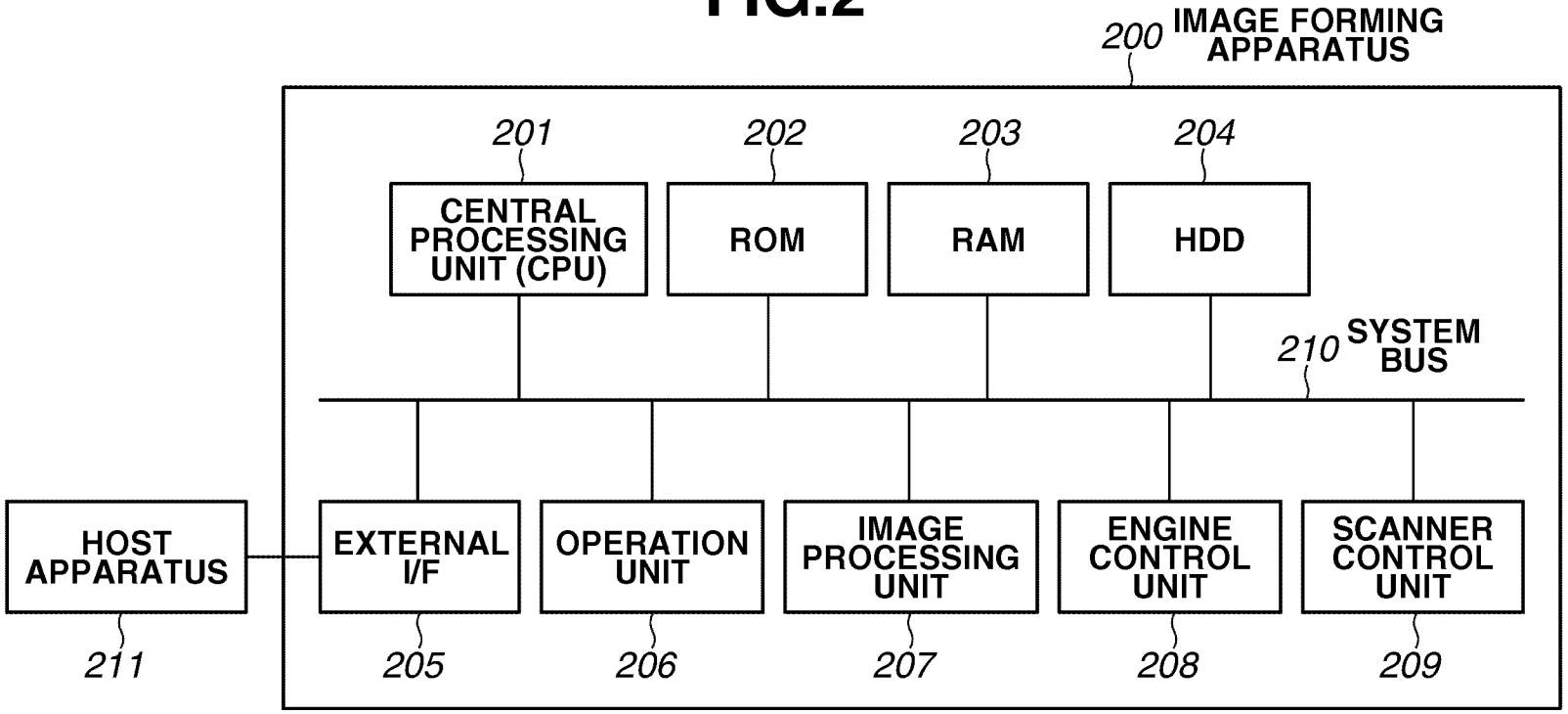
FIG. 2 is a block diagram illustrating an exemplary configuration related to control on the image forming apparatus illustrated in FIG. 1.

FIG. 2 is a block diagram illustrating an exemplary configuration related to control on the image forming apparatus illustrated in FIG. 1. Referring to FIG. 2, an image forming apparatus 200 is the image forming apparatus illustrated in FIG. 1. The configuration of the image forming apparatus 200 illustrated in FIG. 2 is a mere example. Accordingly, the image forming apparatus 200 according to an exemplary embodiment can be implemented by various modifications thereof.

The control unit 108 primarily includes a CPU 201, a read-only memory (ROM) 202, a random access memory (RAM) 203, an image processing unit 207, an engine control unit 208, and a scanner control unit 209. In addition, a hard disk drive (HDD) 204, an operation unit 206, and an external interface (I/F) 205 are connected to a control unit 108 via a system bus 210.

The CPU 201 functions as a central processor and includes a microprocessor (microcomputer). The CPU 201 is included in the control unit 108. The CPU 201 controls the operation of the entire image forming apparatus 200 by executing a program and by activating hardware.

The ROM 202 stores the program executed by the CPU 201 and fixed data necessary for executing various operations of the image forming apparatus 200. The RAM 203 is used as a work area of the CPU 201, a temporary storage area for temporarily storing various received data, and a storage area for storing various setting data.

The HDD 204 can store the program executed by the CPU 201, print data, and setting information necessary for executing various operations of the image forming apparatus 200 on a built-in hard disk. The stored program, print data, and setting information can be read from the built-in hard disk of the HDD 204.

When a print job is input, the CPU 201 sets a unique identification (ID) to the received job in a job queue, which is stored on the HDD 204. The order of executing input print jobs are managed according to the unique ID of each print job. Another mass storage device can be used instead of the HDD 204.

The operation unit 206 includes hard keys and a touch panel, which can be operated by the user to execute various operations. In addition, the operation unit 206 includes a display unit for presenting the user with (i.e., notifying the user of) various information. The operation unit 206 is equivalent to the operation unit 115 illustrated in FIG. 1. The information can be presented to the user by outputting audio information (a buzz or voice) according to information generated by an audio information generation device (not illustrated).

The image processing unit 207 rasterizes (converts) print data (e.g., page description language (PDL) data) processed on the image forming apparatus 200 into image data (a bitmap image) and executes image processing on the rasterized image data. More specifically, the image processing unit 207 converts the color space (for example, YCbCr) of image data included in the input print data into the standard red (R), green (G), and blue (B) (RGB) color space, such as the sRGB color space.

In addition, the image processing unit 207 executes various image processing on the image data where necessary. The image processing executed by the image processing unit 207 on the input image data includes resolution conversion into effective number of pixels, image analysis, and image correction. The image data generated by the above-described image processing is stored on the RAM 203 or the HDD 204.

According to a control command received from the CPU 201, the engine control unit 208 controls processing for printing the image generated based on the input print data on the sheet. In addition, the engine control unit 208 inputs an ink discharge instruction to the printing head 106 corresponding to each color. Furthermore, the engine control unit 208 sets the ink discharge timing to adjust the location of dots (the ink impact position) on the recording medium. Moreover, the engine control unit 208 adjusts the position of the printing head 106 according to acquired information about the status of the printing head driving.

In addition, the engine control unit 208 controls the driving of the printing head. Furthermore, the engine control unit 208 controls the printing head to discharge the ink to form an image on the sheet. Moreover, the engine control unit 208 gives an instruction for driving a sheet feed roller used for feeding the sheet from the cassette. In addition, the engine control unit 208 executes various controls of a conveyance roller used for conveying the fed sheet, such as giving an instruction for driving the conveyance roller and acquiring the rotation status of the conveyance roller. The engine control unit 208 further executes control for conveying the sheet at an appropriate speed in an appropriate sheet conveyance path and for stopping the sheet at an appropriate location on the sheet conveyance path.

According to a control command received from the CPU 201, the scanner control unit 209 controls an image sensor. More specifically, the scanner control unit 209 executes control for reading an image on the sheet to acquire analog (RGB) luminance data and converts the acquired analog data into digital data. A charge-coupled device (CCD) image sensor or a complementary metal oxide semiconductor (CMOS) image sensor can be used as the image sensor. Furthermore, a linear image sensor or an area image sensor can be used as the image sensor.

In addition, the scanner control unit 209 gives an instruction for driving the image sensor and acquires the status information about the image sensor driven according to the image sensor driving instruction. Furthermore, the scanner control unit 209 analyzes luminance data acquired from the image sensor to detect non-discharge of ink from the printing head 106, if any, and detect an appropriate sheet cutting position. If it is determined by the scanner control unit 209 that the image has been normally printed, the sheet is subjected to drying processing for drying the ink applied onto the sheet before being discharged onto the designated tray included in the sorting unit 114.

A host apparatus 211 implements the above-described external apparatus. The host apparatus 211 is externally connected to the image forming apparatus 200 and functions as an apparatus for supplying image data to the image forming apparatus 200, which is to be printed by the image forming apparatus 200. Furthermore, the host apparatus 211 gives an order for executing various print jobs.

The host apparatus 211 can be implemented by a general-purpose personal computer (PC) or by a different type data supply apparatus. The different type data supply apparatus includes an image capturing apparatus configured to capture an image and generate image data based on the captured image. The image capturing apparatus includes a reader (scanner) that reads an image of a document and generates image data based on the read document image. Furthermore, the image capturing apparatus also includes a film scanner that reads a negative or a positive film and generates image data based on the image read from the film.

In addition, a digital camera that captures a still image and generates digital image data can implement the image capturing apparatus as another example thereof. Furthermore, a digital video camera that captures a moving image and generates moving image data based on the captured moving image can also implement the image capturing apparatus as a yet another example of the image capturing apparatus.

Moreover, a photo storage can be provided on a network or a removable portable memory reading interface having a socket-like shape can be provided in the image forming apparatus 200. In this case, an image file stored on the photo storage or on a portable memory device can be read therefrom to generate image data based on the read image and print the generated image data.

In addition, instead of the general-purpose PC, the host apparatus 211 can be implemented by a terminal dedicated to use as the host apparatus 211. In other words, various types of data supply apparatuses can implement the host apparatus 211. The above-described various types of data supply apparatuses can be included in the image forming apparatus or can be separately provided and externally connected to the image forming apparatus.

If a PC is used as the host apparatus 211, an operating system (OS), application software for generating image data, and a printer driver for the image forming apparatus 200 are installed on a storage device included in the PC. The printer driver controls the image forming apparatus 200 and converts image data supplied from the application software into image data having a format with which the image forming apparatus 200 can interpret the image data to generate print data based on the image data. Alternatively, the host apparatus 211 can convert the print data into image data and supply the converted image data to the image forming apparatus 200.

In the present invention, it is not required to implement all of the above-described processing by software. In other words, a part of or the entire processing can be implemented by hardware, such as application specific integrated circuit (ASIC).

Image data, various other commands, and status signals supplied from the host apparatus 211 can be transmitted to the image forming apparatus 200 via the external I/F 205. The external I/F 205 can be a local I/F or a network I/F. In addition, the connection via the external I/F 205 can be either wired or wireless. The above-described components of the image forming apparatus 200 are mutually connected and in communication with one another via the system bus 210.

As described above, one CPU 201 controls the operations of all the components of the image forming apparatus 200 illustrated in FIG. 2. However, the present invention is not limited to this. More specifically, some of the above-described functional blocks can include a separate CPU. In this case, each CPU can execute a unique control.

In addition, the above-described functional blocks can employ various functional configurations different from the configuration illustrated in FIG. 2 to execute differently shared functions. More specifically, each functional block described above can be divided into separate processing units or control units. Furthermore, some of the above-described functional blocks can be implemented integrally as one unit. Moreover, the data can be read from the memory by using a direct memory access controller (DMAC).

Figure 3:
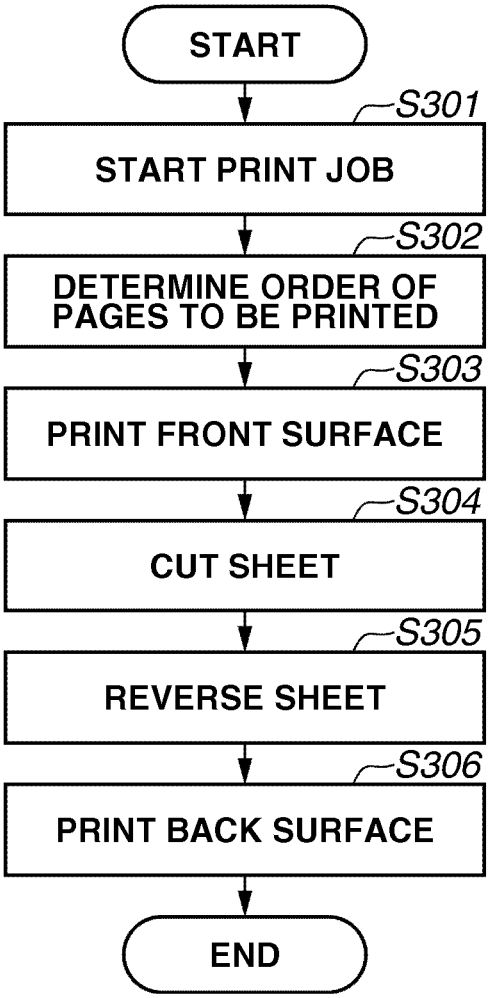
FIG. 3 is a flow chart illustrating an exemplary flow of two-sided printing according to an exemplary embodiment.

Now, an exemplary processing performed by the image forming apparatus 200 having the above-described configuration to execute a print job will be described in detail below. FIG. 3 is a flow chart illustrating an exemplary flow of processing performed by the image forming apparatus 200 in executing a two-sided print job input thereto.

Processing according to the flow chart of FIG. 3 can be implemented by the CPU 201 by loading and executing a control program from the ROM 202 or the HDD 204 on the RAM 203. In an exemplary embodiment, it is supposed that the user has previously executed an operation via the operation unit 206 to register in the RAM 203, the size (the roll sheet width) and a type (a normal paper, a glossy paper, or a film) of the sheet that has been set in each of the upper-stage sheet cassette 101*a* and the lower-stage sheet cassette 101*b*.

Referring to FIG. 3, when a print job is received via the external I/F 205, processing of the print job starts in step S301. The received print job is temporarily stored on the HDD 204. In step S302, the CPU 201 determines the order of printing pages included in the received print job.

In step S302, the CPU 201 determines the order of printing the pages to execute the print job in the following manner. More specifically, the CPU 201 performs control for serially executing printing of a plurality of pages on the first surface (e.g., the front surface) of the sheet before serially executing printing of the plurality of pages on the opposite surface.

The serial printing of the plurality of pages on the same surface of the sheet can be executed if the printing is executed by using the sheets having the same sheet size and the same sheet type. However, it is not always necessary that the sheets of the same sheet size are used. More specifically, if printing on a sheet of a size larger than the size of the sheet to be output, which has been designated in the print job, has been previously permitted, the sheets of mutually different sizes can be used. Furthermore, if the sheet type is not to be particularly used as a basis of determining the printing order, sheets of mutually different types can be used.

However, the printing order can be determined by a method different from the above-described method. In other words, whether to serially perform printing of the plurality of pages of the print job can be determined according to a printing mode (i.e., one-sided printing, two-sided printing, and book binding processing). To paraphrase this, the printing according to an exemplary embodiment can be implemented if images of a plurality of pages, which can be printed on the same sheet, can be serially printed.

The serial printing of the plurality of pages on the same surface can be executed during processing of one print job only. However, the present invention is not limited to this. More specifically, the serial printing of the plurality of pages on the same surface can be executed during processing of a plurality of print jobs.

The printing order of printing on a second (the opposite) surface is reversed from that of printing on the first surface. In other words, if the printing on the first surface is executed in ascending order, the printing on the second surface is executed in descending order. This is because in executing printing on the second surface, the sheet is cut after the last printing on the first surface is executed and the cut sheet is conveyed with an edge of the sheet on which the sheet has been cut (i.e., the opposite surface of the sheet having the image of the page printed the last) now having become a leading edge of the sheet to be conveyed for the printing on the second sheet.

In step S303, the CPU 201 starts the printing on the first surface (i.e., the front surface) of the sheet according to the page order determined in step S302. More specifically, the CPU 201 supplies the image processing unit 207 with print data of each page according to the printing order determined in the above-described manner.

The image processing unit 207 converts the print data supplied from the image processing unit 207 into a format with which the print data to be printed on the front surface can be printed (i.e., executes rasterization into image data) and then stores the converted image data on the HDD 204. Furthermore, the image processing unit 207 supplies the generated image data to the engine control unit 208 in the above-described page order.

Furthermore, in step S303, the image processing unit 207 notifies the engine control unit 208 of information about a surface of the sheet on which the image data is to be printed, and a page to which the image data corresponds as well as information for uniquely identifying the print job together with the image data.

After receiving the image data, the engine control unit 208 executes control for feeding the sheet from the upper-stage sheet cassette 101*a* or the lower-stage sheet cassette 101*b*. The cassette from which the sheet is to be fed is determined according to the size of the image to be printed and the type of the sheet used in the printing.

In addition, the engine control unit 208 controls the conveyance unit 102 to convey the sheet to a printing position at which the head unit 105 prints the image to serially print the images on the front surface of the sheet. Then the sheet is conveyed to a reading position, at which the scanner unit 107 reads the printed image.

The CPU 201 verifies whether the image has been normally printed by reading the printed image using the scanner unit 107 according to a content of the image data acquired by reading the printed image. Then the sheet is conveyed towards the cutter unit 110.

If it is determined that the image has been normally printed, the CPU 201 executes control for not cutting the sheet by using the cutter unit 110 in the unit of a page at this timing. Then, in this case, the sheet is conveyed into the drying unit 112 in a state in which sheets having the images corresponding to the plurality of pages are yet to be cut in the unit of a page. Then, the drying unit 112 executes processing for drying the ink applied on the sheet and the sheet is wound up by the sheet winding unit 113.

Because two-sided printing is currently executed, the sheet is wound up by the sheet winding unit 113 without cutting the same into a plurality of sheets. If one-sided printing is executed, the sheet is cut in the unit of a page (note that the sheet may not be cut in some cases) (i.e., the sheet is not wound up by the sheet winding unit 113).

On the other hand, if it is determined that the image has not been normally printed, the CPU 201 controls the cutter unit 110 to cut the sheet to discharge the sheet having the image of the page that has not been normally printed. The CPU 201 further executes control for discharging the cut sheet having the failed page image selectively onto a tray for stacking poorly printed sheets selected from among the trays of the sorting unit 114 (i.e., onto a lowermost tray).

In this case, in order to normally print the page that has not been normally printed yet, by executing printing thereof again, the CPU 201 supplies the image data to the engine control unit 208 and performs control for executing the subsequent processing again. After completing the printing of the serial printing on the sheet front surface, the processing advances to step S304. In step S304, the cutter unit 110 cuts the sheet having the image printed on the front surface thereof.

In step S305, the sheet having the image printed on the front surface thereof and having been wound up by the sheet winding unit 113 is conveyed again into the conveyance unit 102 with the surface of the sheet opposite to the first surface thereof facing the head unit 105. The printing on the back surface can be executed in the same manner as the printing on the front surface. Accordingly, the printing on the back surface will not be described in detail below. However, after the printing on the back surface is completed, the cutter unit 110 cuts the sheet in the unit of a page (in the case of book binding processing, the sheet can be cut in the unit of two pages). The cut sheets are discharged onto the tray of the sorting unit 114.

If it has been previously designated in the print job not to cut the sheet at this timing, the cutter unit 110 does not cut the sheet at this timing. As described above, an embodiment executes the two-sided printing if no cause for suspending the printing does not arise during the printing.

On the other hand, if a one-sided print job has been input, an embodiment executes the printing in the following manner. More specifically, after completing the printing on the first surface of the sheet, the cutter unit 110 serially cuts the sheet having the printed image in the unit of a page. The cut sheets are serially discharged onto the tray of the sorting unit 114.

Figures 4, 4A:
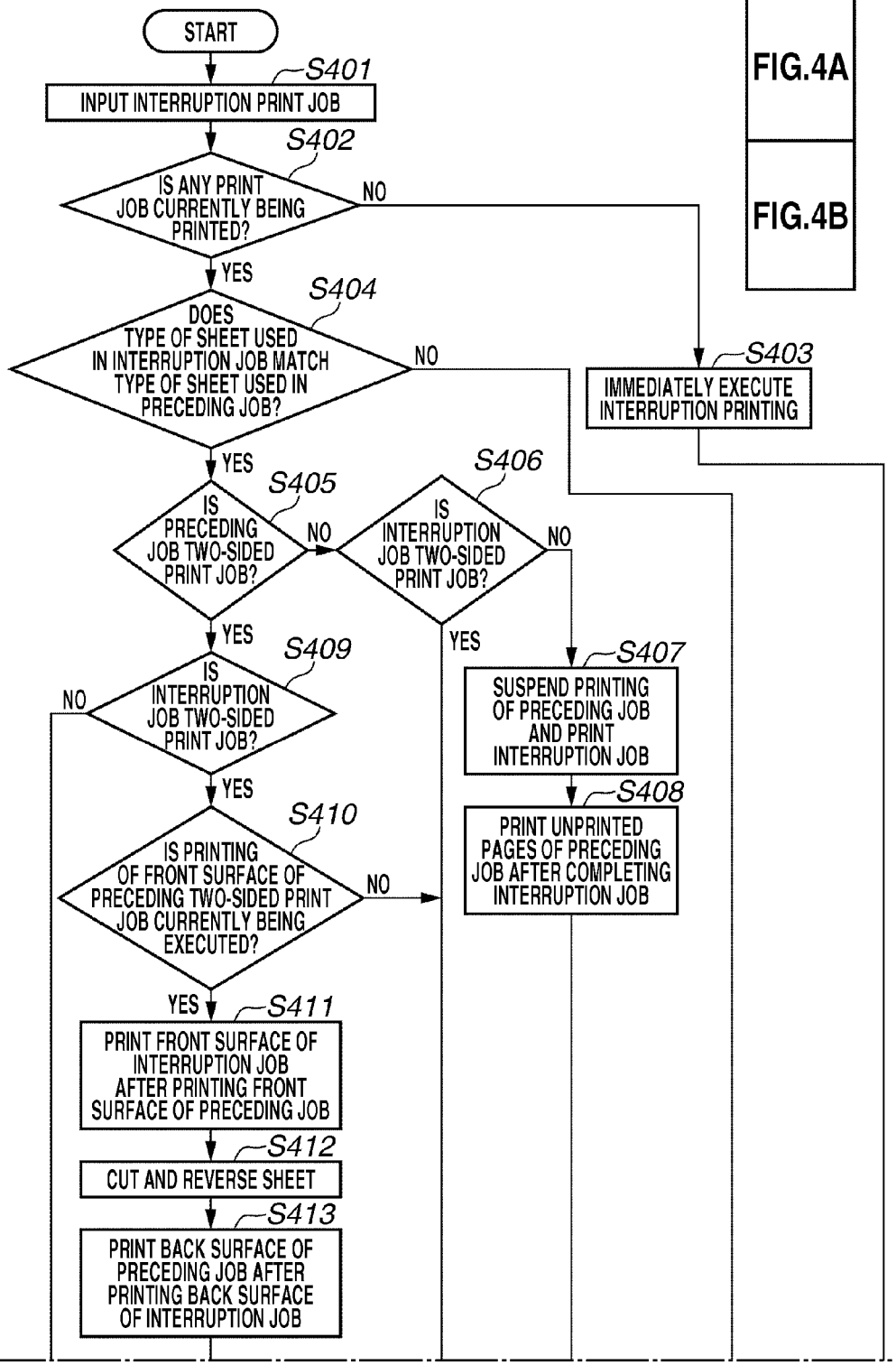
FIG. 4A and FIG. 4B are a flow chart illustrating an exemplary flow of interruption printing according to an exemplary embodiment.
Figure 4B:
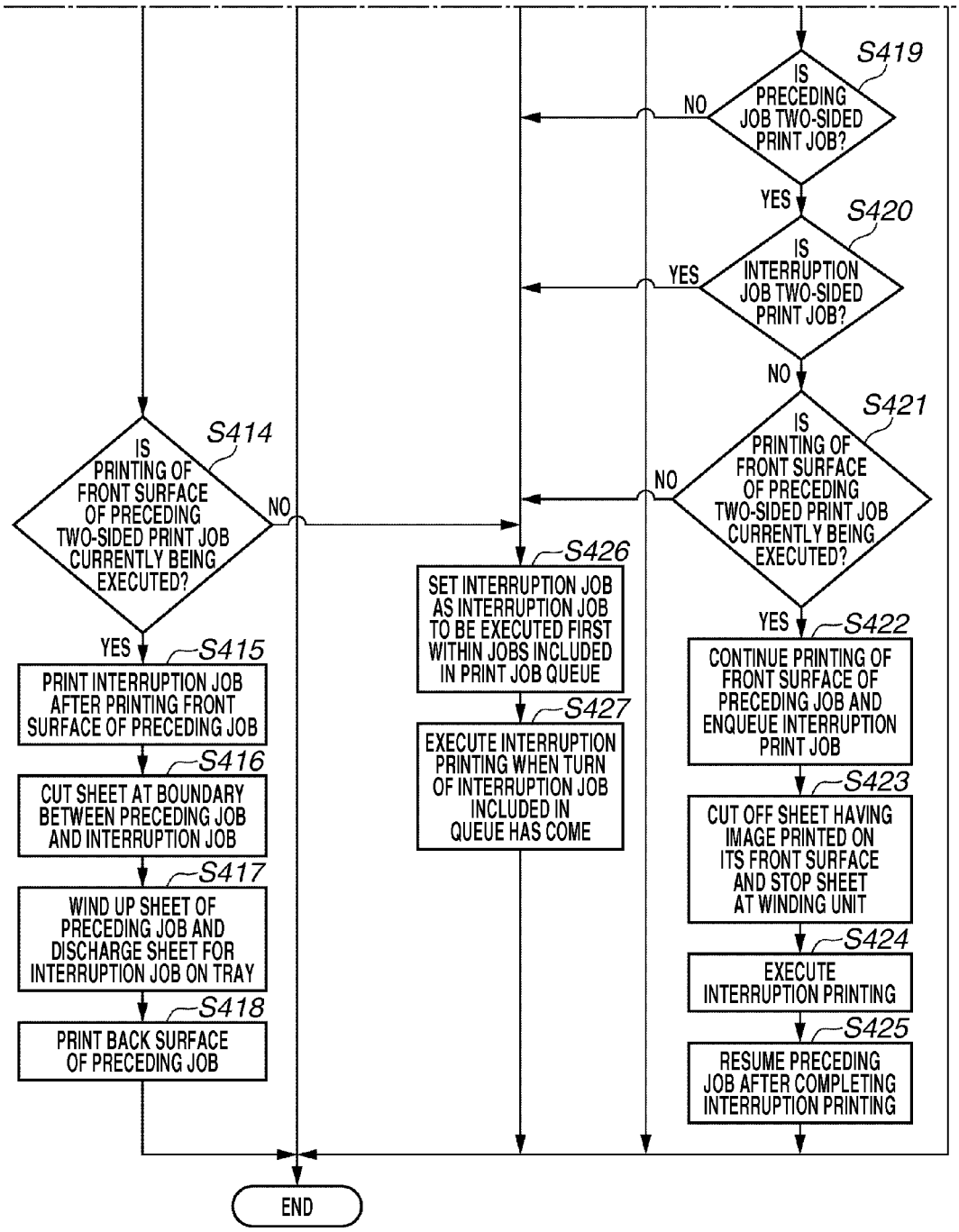

Processing executed if an interruption print job is input after the above-described two-sided print job or one-sided print job has been input will be described in detail below with reference to FIG. 4. FIG. 4 is a flow chart illustrating an exemplary flow of interruption printing according to an exemplary embodiment. Processing according to the flow chart of FIG. 4 can be implemented by the CPU 201 by loading and executing a control program from the ROM 202 or the HDD 204 on the RAM 203.

Referring to FIG. 4, in step S401, the user inputs an instruction for interruption printing (i.e., an instruction for moving up the printing order of the interruption print job as a result). In an embodiment, it is supposed that a print job including information indicating that the newly input print job is to be urgently and immediately executed has been input by the host apparatus 211 as an interruption print job. However, the interruption print job according to the present invention is not limited to this. More specifically, the interruption print job can also include a print job which has been selected via the host apparatus 211 or the operation unit 206 and which has been instructed to be urgently executed, among print jobs that have already been input to the image forming apparatus 200.

In addition, if a print job exists whose priority order is lower than the priority order of the job about to be executed, based on the priority order designated for each print job or the priority order designated by the user who has input the print job about to be executed, the newly input can be executed before executing the low priority print job even if no urgent print job has been input during the current printing. Furthermore, if the user directly designates the print job input during the current print job to bean "interruption print job", the interruption print job designated by the user can be executed in priority to the normal print job (i.e., the print job that has not been designated as an interruption print job).

In step S402, the CPU 201 determines whether any preceding job currently being printed exists. If any print job that has been input to the image forming apparatus 200 before the interruption print job is input is not currently enqueued (i.e., waiting to be printed), the CPU 201 determines that no preceding job currently being printed exists. Furthermore, if the printing in one unit of printing has been completed, if next printing in one unit of printing is ready, and if the image forming apparatus 200 is not currently executing printing, then the CPU 201 determines that no currently printed preceding job exists.

If it is determined that no currently printed preceding job exists (No in step S402), then the processing advances to step S403. In step S403, the CPU 201 executes control for performing the printing of the print job input in step S401. On the other hand, if it is determined that any currently printed preceding job exists (Yes in step S402), then the processing advances to step S404.

In step S404, the CPU 201 determines whether the type of the sheet that has been designated in the interruption print job input in step S401 (i.e., the sheet size, a material of the sheet, or the like) is the same as the type of the sheet used in the preceding job. The sheet type used as a basis of executing the determination in step S404 can include either the sheet size or the sheet material only.

If the image forming apparatus 200 is compliant with a specific type sheet or if the print job does not include a designation on the sheet type, then the determination in step S404 and processing in steps S419 through S425 is to be omitted. More specifically, the processing is branched according to whether printing of the interruption print job can be executed continuously based on the sheet used in the preceding job.

If it is determined that the same type sheet is used (Yes in step S404), then the processing advances to step S405. On the other hand, if it is determined that the sheet type of the interruption print job is not the same as the type of the sheet used in the preceding job (No in step S404), then the processing advances to step S419.

In step S405, the CPU 201 determines whether the preceding job is a print job that requires printing on both surfaces of the sheet. If it is determined that the preceding job is a print job that requires printing on both surfaces of the sheet (Yes in step S405), then the processing advances to step S409. On the other hand, if it is determined that the preceding job does not require printing on both surfaces of the sheet (No in step S405), then the processing advances to step S406.

In step S406, the CPU 201 determines whether the interruption print job input in step S401 is a print job that requires printing on both surfaces of the sheet. If it is determined that the interruption print job input in step S401 is a job that requires printing on both surfaces of the sheet (Yes in step S406), then the processing advances to step S426. On the other hand, if it is determined that the interruption print job input in step S401 does not require printing on both surfaces of the sheet (No in step S406), then the processing advances to step S407.

In step S407, the CPU 201 suspends the preceding job being currently printed and starts printing of the interruption print job input in step S401. The preceding job can be suspended when printing of a currently printed page is completed. Alternatively, the preceding job can be suspended when the printing of the image data for the number of pages that has become ready to be printed under control of the engine control unit 208 is completed.

After the printing of the interruption print job has been completed, in step S408, the CPU 201 executes control for performing the printing of the remaining pages of the suspended preceding job.

Because both the preceding job and the interruption print job are a one-sided print job, the printed sheet is not wound up by the sheet winding unit 113. Then the printed sheet is cut by the cutter unit 110 and the cut sheets are discharged on the designated tray.

In step S409, the CPU 201 determines whether the interruption print job input in step S401 requires printing on both surfaces of the sheet. If it is determined that the interruption print job input in step S401 requires printing on both surfaces of the sheet (Yes in step S409), then the processing advances to step S410. On the other hand, if it is determined that the interruption print job input in step S401 does not require printing on both surfaces of the sheet (No in step S409), then the processing advances to step S414.

In step S410, the CPU 201 determines whether printing of the front surface of the two-sided printing of the preceding job determined to have been currently printed in step S402 is currently printed. If the printing on the back surface of the sheet has been already started (No in step S410), then the processing advances to step S426. On the other hand, if the printing on the front surface of the sheet is currently executed or if the sheet is currently wound up by the sheet winding unit 113 after completing the printing on the front surface of the sheet (i.e., if the printing on the back surface has not been started yet) (Yes in step S410), then the processing advances to step S411.

To paraphrase this, the determination in step S410 is executed if the printing on the back (second) surface of the sheet in preceding two-sided printing job has not been started yet. In step S411, the CPU 201 executes control for printing the front surface of the interruption print job subsequent to completing the printing on the front surface of the preceding job.

In this case, after the last image is printed on the front surface in the preceding job, the cutter unit 110 does not cut the sheet and the processing advances to the printing on the front surface of the interruption print job. Because the printing executed in this case is two-sided printing, the printed sheet is wound up by the sheet winding unit 113.

Accordingly, neither cutting of the sheet nor winding of the sheet back into the cassette becomes necessary between the preceding job and the interruption print job. Therefore, an embodiment can effectively avoid executing unnecessary processing.

In step S412, the CPU 201 controls the cutter unit 110 to cut the sheet at a timing of printing the last image of the printing on the front surface of the interruption print job. Then the sheet is reversed to execute printing on the back surface of the sheet.

In step S413, the CPU 201 executes printing on the back surface of the interruption print job. After the interruption print job is completed, the printing on the back surface of the preceding job is executed. In this case, the cutter unit 110 cuts the sheet in the unit of a page. The sheets printed by the interruption print job and those printed by the preceding job are discharged onto different trays of the sorting unit 114 to prevent an adverse mixture of the sheets.

As described above, in this case, the printing on the back surface of the interruption print job is executed in priority because the reversed sheet reaches the printing head 106 starting from the sheet on which the last image printed on the front surface of the interruption print job has been printed. As a result, the interruption print job can be printed prior to the preceding job. Accordingly, the interruption print job can be completed in sufficiently short time while preventing a great delay in processing the preceding job.

In step S414, the CPU 201 determines whether the printing of the front surface of the preceding two-sided print job which is determined to have been currently printed in step S402 is currently executed. The determination in step S414 is similar to the determination executed in step S410. If it is determined that the printing of the front surface of the preceding two-sided print job determined to have been currently printed in step S402 is currently executed (Yes in step S414), then the processing advances to step S415. On the other hand, if it is determined that the front surface of the preceding two-sided print job determined to have been currently printed in step S402 is not currently printed (No in step S414), then the processing advances to step S426.

In step S415, the interruption print job, which is one-sided print job, is printed subsequent to the printing on the front surface of the preceding job. In this case, because the preceding job is a two-sided print job, the sheet winding unit 113 winds up the sheet after the leading edge of the sheet is completely conveyed through the drying unit 112.

More specifically, in this case, because the preceding job is a two-sided print job when the interruption print job is a one-sided print job, the printed sheet is supplied to the sheet winding unit 113. If a one-sided print job is to be executed when no preceding job is currently printed, the printed sheet is not supplied to the sheet winding unit 113.

In step S416, the cutter unit 110 cuts the sheet at a boundary between the last image printed on the front surface of the preceding job and the first image of the interruption print job. In other words, when the boundary between the last image of the preceding job and the first image of the interruption print job reaches the position for cutting the sheet by using the cutter unit 110 after the sheets having the image for the front surface of the preceding job printed thereon and the sheet having the image of the interruption print job printed thereon are conveyed, the cutter unit 110 cuts the sheet.

In step S417, the winding of the sheet used in the preceding job whose front surface printing has been executed by the sheet winding unit 113 is continued. On the other hand, the sheet used in the interruption print job having the image printed thereon is discharged on a designated tray of the sorting unit 114 by changing the conveyance path after the sheet of the preceding job is conveyed to the sheet winding unit 113. At this time, the sheet of the interruption print job is being cut by the cutter unit 110 in the unit of a page.

Furthermore, in this case, a tray designated when the interruption print job has been instructed or a tray for an interruption print job is used as the tray that is the destination of the discharged sheet of the interruption print job. More specifically, the tray that is the destination of the discharged sheet of the interruption print job is different from the tray for the preceding job. Accordingly, an adverse mixture of sheets of the preceding job and the interruption print job can be effectively prevented.

As described above, in step S417, the sheet printed in step S415 is supplied to the sheet winding unit 113 while the sheet for the interruption print job is cut without being wound up by the sheet winding unit 113. The cut sheets for the interruption print job are conveyed to the sorting unit 114.

In step S418, the sheet of the preceding job is conveyed from the sheet winding unit 113 with the surfaces of the sheet being upside down after completing the printing of the interruption print job. Then the printing of the back surface of the preceding job is executed.

In this case, the sheet having the image printed on the back surface thereof is then cut by the cutter unit 110 in the unit of a page. The cut sheets are discharged on a tray designated for the preceding job. Furthermore, the sheets of the preceding job are discharged on a tray different from the tray for the interruption print job. Accordingly, an adverse mixture of the sheets of the preceding job and the interruption print job can be effectively prevented. Therefore, the user is allowed to easily recognize and take out appropriate sheets.

In step S419, the CPU 201 determines whether the preceding job requires printing on both surfaces of the sheet. If it is determined that the preceding job requires printing on both surfaces of the sheet (Yes in step S419), then the processing advances to step S420. On the other hand, if it is determined that the preceding job does not require printing on both surfaces of the sheet (No in step S419), then the processing advances to step S426.

In step S420, the CPU 201 determines whether the interruption print job input in step S401 requires printing on both surfaces of the sheet. If it is determined that the interruption print job input in step S401 requires printing on both surfaces of the sheet (Yes in step S420), then the processing advances to step S426. On the other hand, if it is determined that the interruption print job input in step S401 does not require printing on both surfaces of the sheet (No in step S420), then the processing advances to step S421.

In step S421, the CPU 201 determines whether the printing of the front surface of the preceding two-sided print job determined to have been currently printed in step S402 is currently executed. In other words, in step S421, the CPU 201 executes the same determination as that in step S410.

If it is determined that the printing of the front surface of the preceding two-sided print job determined to have been currently printed in step S402 is currently executed (Yes in step S421), then the processing advances to step S422. On the other hand, if it is determined that the printing of the front surface of the preceding two-sided print job determined to have been currently printed in step S402 is not currently executed (No in step S421), then the processing advances to that in step S426.

In step S422, the printing of the front surface of the preceding job is continued. During the continued printing of the front surface of the preceding job, the interruption print job is temporarily stored on the HDD 204 waiting for printing.

In an embodiment, printing of all the pages to be printed on the front surface of one print job is continued. However, the present invention is not limited to this. More specifically, instead of the above-described configuration, all the pages to be printed on the front surface of a plurality of print jobs that have been determined in step S302 to be serially printed on the front surface of the sheet can be printed.

If it is determined that the printing of the front surface has already been completed (No in step S421), then the processing advances to step S422. In step S422, the CPU 201 merely causes the interruption print job to be enqueued for printing. Because the preceding job is a two-sided print job in this case, the printed sheet is wound up by the sheet winding unit 113.

In step S423, after completing the printing of the front surface of the preceding job, the cutter unit 110 cuts the sheet. Then the sheet is wound up by the sheet winding unit 113. The sheet is stopped at the sheet winding unit 113 in the wound-up state waiting for resumption of its printing.

In step S424, the CPU 201 executes the printing of the interruption print job that has been enqueued since step S422. In this case, because the sheet for the interruption print job is different from the sheet for the preceding job, the sheet set in a cassette different from the cassette from which the sheet for the preceding job is fed. Alternatively, the sheet is fed after exchanging the sheets contained in the cassette that is the sheet feeding source for the preceding job.

After the printing on the sheet for the interruption print job is executed, the sheet for the interruption print job is cut by the cutter unit 110 in the unit of a page. The cut sheets are discharged on a designated tray. In this case, the sheets printed by the interruption print job are discharged onto a tray different from the tray designated for the preceding job. Accordingly, an adverse mixture of the sheets of the preceding job and the interruption print job can be effectively prevented.

After the printing of the interruption print job is completed in step S424, the processing advances to step S425. In step S425, the CPU 201 resumes the printing of the preceding job. More specifically, the CPU 201 executes control for reversing the surfaces of the sheet stopped at the sheet winding unit 113 upside down and for conveying the reversed sheet to the printing head 106 to execute the printing on the back surface of the sheet.

In this case, the cutter unit 110 cuts the sheet in the unit of a page. The cut sheets are discharged onto a designated tray. More specifically, the sheets are discharged on a tray different from a sheet discharge destination tray used for the interruption print job.

In step S426, the CPU 201 sets the interruption print job input in step S401 as a first job to be executed next, i.e., as a first interruption print job to interrupt, among the enqueued print jobs. In other words, even if any subsequent print job whose printing is yet to be started exists, the CPU 201 executes control for starting printing of the interruption print job. In this case, the printing of the preceding job, whose printing has been already started, is continued without suspension.

In step S427, after printing the preceding job and when the turn for processing the interruption print job enqueued in the queue comes, the CPU 201 executes the printing of the interruption print job. The sheet of the preceding job whose printing has been executed in step S426 and the sheet of the interruption print job whose printing has been executed in step S427 are discharged onto different trays. Accordingly, an adverse mixture of the sheets for the preceding job and the interruption print job can be effectively prevented.

In steps S412 and S423, the sheet may not be cut if all the sheets set in the cassette are to be used. This is because the winding of the sheet by the sheet winding unit 113 can be completed if the sheet is separated from the upper-stage sheet cassette 101*a* or the lower-stage sheet cassette 101*b*.

The method for preventing an adverse mixture of the sheets for the preceding job and the interruption print job can be implemented by the following method. More specifically, a specific tray of the trays of the sorting unit 114 can be used to discharge the sheet of the interruption print job thereon to prevent the mixture of the sheets discharged by the printing of the preceding job and the sheets discharged by the printing of the interruption print job. For example, the uppermost large tray can be used as the discharge tray for the interruption print job.

With the above-described configuration, in executing printing that uses a continuous sheet, an exemplary embodiment can securely input and execute a subsequent job without wastefully discarding the printed sheets of the preceding job whose printing has been already started when the subsequent job is input. In addition, an exemplary embodiment having the above-described configuration can execute interruption printing without considerably delaying the time of completion of the preceding job.

Furthermore, in an exemplary embodiment, the preceding job and the interruption print job can be executed continuously without cutting the sheet during the continued printing. Accordingly, an embodiment can effectively reduce the number of times of winding of the sheet back into the cassette and the number of times of re-conveyance of the sheet from the cassette. Therefore, an exemplary embodiment can effectively execute both the preceding job and the interruption print job.

In the above-described example, if it is determined that the printing of the back surface of the preceding job has been already been started in steps S410, S414, and S420, the interruption print job is executed in step S426 after completing the preceding job. However, the interruption print job can be executed before completing the preceding job in this case.

In other words, if the printing of the back surface of the preceding job is currently executed when an instruction for the interruption printing is input, the sheet for the preceding job can be stopped by reversely rotating the sheet winding unit 113 at a timing of cutting the sheet after completing the printing of the back surface of the sheet up to the stage at which the printing of the back surface of the preceding job can be stopped. Therefore, in this case, the interruption print job can be executed because the sheet for the preceding job can be stopped. After the interruption print job is completed, the remaining portion of the printing of the back surface of the preceding job can be executed.

Accordingly, the interruption printing can be completed within a short time period even if the printing of the back surface of the preceding job has already been started. In this case, the sheet discharged after printing the print job can be discharged on the same tray for the preceding job before and after inputting of the interruption print job. Alternatively, the sheet can be discharged onto a tray other than the tray used before the interruption print job is input or a tray other than the tray for the interruption print job.

If the former configuration is employed, the user may not be required to rearrange the sheets in the timing of input of the interruption print job. On the other hand, if the latter is employed, the sheets printed before the interruption print job is executed and those printed after the input of the interruption print job can be easily separated from one another.

In addition, in the above-described example, in steps S411, S415, and S421, the printing of the front surface of the preceding job is completed for the number of pages that have been determined to be continuously printed. However, the interruption print job can be started before completing the printing.

More specifically, if the printing of the front surface of the preceding job is currently executed when the instruction for the interruption print job is input in step S401, the printing of the front surface of the preceding job is suspended upon completion of the printing of the front surface of the preceding job up to the stage where the printing of the front surface of the preceding job can be stopped. In this state, the cutter unit 110 cuts the sheet. Then the cut sheets are wound up by the sheet winding unit 113 to be in a stand-by state. Then the interruption print job is executed. Then the printing of the enqueued preceding job is resumed.

In resuming the preceding job, it becomes necessary to change the printing order. More specifically, in resuming the preceding job, because the printing of the front surface has been already completed to some degree (but not entirely completed), it becomes necessary to execute printing on the opposite surface.

Accordingly, the CPU 201 executes control for identifying how many pages of the preceding job to be printed on the front surface have been already printed. In this case, the CPU 201 executes control for printing the opposite surface of the sheets whose printing of the front surface has been already executed. Subsequently, the remaining pages to be printed on the front surface are printed. Then the printing of the opposite surfaces corresponding to the printed front pages is executed. The printing order is changed to execute the printing in the above-described order.

In this case, the sheet discharged after printing the preceding job can be discharged on the same tray for the preceding job before and after inputting of the interruption print job. Alternatively, the sheet can be discharged on to a tray other than the tray used before the interruption print job is input or a tray other than the tray for the interruption print job. As described above, the interruption print job can be completed in a short time period.

Furthermore, it can be determined whether to suspend the printing of the preceding job on the same surface according to whether the remaining available sheet amount (the length of the sheet in the conveyance direction) of the preceding job is larger than a predetermined length when the instruction for the interruption print job is input.

Moreover, in the above-described example, when two-sided printing is executed, the sheet whose printing on the first surface has been completed is wound up by the sheet winding unit 113. However, the sheet can also be stopped without winding it up in a roll-like shape. More specifically, in this case, a sheet reversal mechanism can be used, which is capable of stopping the sheet after serially executing printing on the first surface thereof (by stopping the sheet at a specific position within the printing unit) and also capable of executing the printing on the second surface after the sheet is reversed. In other words, various methods different from that described above can be used to stop and reverse the sheet.

Furthermore, the above-described exemplary embodiment can also be implemented by the following configuration. More specifically, an external apparatus, such as a host apparatus or an external controller, can implement scheduling (the determination) of the printing order and the determination as to whether an interruption print job can be input excluding the print processing itself. In this case, the image forming apparatus can execute the printing according to the printing order or the availability of printing of the interruption print job determined by the external apparatus.

In this case, the external apparatus can preferably determine the printing order or the timing of inputting the interruption print job based on status information (information including the status of progress of the current printing) about the image forming apparatus. The external apparatus can function as the printing control apparatus in this case.

As described above, an exemplary embodiment, in executing an interruption print job by one-sided printing subsequent to the printing on the first surface of the continuous sheet used in a preceding two-sided print job, supplies the printed continuous sheet to the reversal unit. Accordingly, when two-sided printing on a continuous sheet is currently executed, the exemplary embodiment having the above-described configuration can input another print job as an interruption print job and can complete the preceding two-sided print job without wastefully suspending the same.

In addition, in executing control for performing the interruption printing by two-sided printing following the printing on the first surface of the continuous sheet by the preceding two-sided printing, the exemplary embodiment executes control for performing the printing on the first surface of the interruption printing subsequently thereto. After that, the printing on the second surfaces of the preceding two-sided print job and the interruption print job is executed. Therefore, when a two-sided print job on a continuous sheet is currently executed, the exemplary embodiment having the above-described configuration can input and execute another two-sided print job as an interruption print job while it can appropriately complete the preceding two-sided print job.

An embodiment can also be achieved by providing a system or an apparatus with a storage medium storing program code of software implementing the functions of the embodiments and by reading and executing the program code stored in the storage medium with a computer of the system or the apparatus (a CPU or an MPU). In an example, a computer-readable medium may store a program that causes a printing control apparatus to perform a method described herein. In another example, a central processing unit (CPU) may be configured to control at least one unit utilized in a method or apparatus described herein.

In this case, the program can be executed on one computer or on a plurality of computers operating in conjunction with one another. In addition, it is not required to implement all the above-described processing by software. In other words, a part of or the entire processing described above can also be implemented by hardware.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An apparatus configured to cause a printing unit to execute printing on a continuous sheet, the apparatus comprising:

a printing control unit configured to cause the printing unit to execute, in a case where a first job is a two sided printing job and a second job is a one-sided printing job, printing of the second job subsequent to printing of the first job on a first surface of the continuous sheet, configured to cause a supplying unit to supply the printed continuous sheet to a reversal unit which reverses the continuous sheet for printing on a second surface of the continuous sheet after executing printing on the first surface of the continuous sheet and, configured to cause the printing unit to execute printing of the two-sided printing job on the second surface of the printed continuous sheet, wherein, in a case where the first job is a two-sided printing job and the second job is a one-sided printing job and printing on the first surface of the continuous sheet of the first job is being executed by the printing unit when an instruction for printing of the second job is input by an input unit, the printing control unit causes a cutter unit to cut the continuous sheet between a printed image of the first job and a printed image of the second job after causing the printing unit to begin printing of the second job, and causes the supplying unit to supply, to the reversal unit, the continuous sheet on which the printed image of the first job has been printed.

2. The apparatus according to claim 1, wherein the printing control unit causes a cutter unit to cut the printed continuous sheet after the printing on the first surface of the continuous sheet of the second job has been executed by the printing unit, and causes the supplying unit to supply, to the reversal unit, the printed continuous sheet after cutting by the cutter unit.

3. The apparatus according to claim 1, wherein the printing control unit causes the supplying unit to discharge, to different discharge destinations, a sheet on which printing of the first job has been executed and a sheet on which printing of the second job has been executed.

4. The apparatus according to claim 1, wherein, after completion of printing of the first job on the first surface of the continuous sheet, the printing control unit causes the printing unit to start printing of the second job.

5. The apparatus according to claim 1, wherein, without awaiting completion of printing of the first job on the first surface of the continuous sheet, the printing control unit causes the printing unit to start printing of the second job.

6. The apparatus according to claim 1, further comprising a determination unit configured to determine whether a type of continuous sheet used in the first job is same as a type of continuous sheet used in the second job, wherein, in a case where the determination unit determines that the type of the continuous sheet used in the first job is the same as the type of the continuous sheet used in the second job, the printing control unit causes the printing unit to begin printing of the second job subsequent to the printing of the first job and, wherein, in a case where the determination unit determines that the type of continuous sheet used in the first job is not the same as the type of continuous sheet used in the second job, the printing control unit causes the printing unit to wait for execution of printing of the second job until the printing on the first surface and the second surface of the continuous sheet of the first job is completed.

7. The apparatus according to claim 6, wherein, if the determination unit determines that the type of the continuous sheet used in the first job is not the same as the type of the continuous sheet used in the printing, the printing control unit causes, in a case where printing of the first job for performing the two-sided printing job on the first surface of the continuous sheet is being executed by the printing unit when the instruction for the one sided job of the second job is input by an input unit, the supplying unit to supply the continuous sheet on which printing of the first job has been executed to the reversal unit to wait, and causes the printing unit to begin printing of the second job.

8. The apparatus according to claim 7, wherein the printing control unit causes the printing unit to restart printing of the first job after completion of printing of the second job.

9. A method for controlling an apparatus configured to cause a printing unit, having a printing control unit, to execute printing on a continuous sheet, the method comprising:

causing, via the printing control unit, the printing unit to execute, in a case where a first job is a two-sided printing job and a second job is a one-sided printing job, printing of the second job subsequent to printing of the first job on a first surface of the continuous sheet;

causing, via the printing control unit, a supplying unit to supply the printed continuous sheet to a reversal unit which reverses the continuous sheet for printing on a second surface of the continuous sheet after executing printing on the first surface of the continuous sheet; and causing, via the printing control unit, the printing unit to execute the printing of the two-sided printing job on the second surface of the printed continuous sheet, wherein, in a case where the first job is a two-sided printing job and the second job is a one-sided printing job and printing on the first surface of the continuous sheet of the first job is being executed by the printing unit when an instruction for printing of the second job is input by an input unit, the method further includes:

causing, via the printing control unit, a cutter unit to cut the continuous sheet between a printed image of the first job and a printed image of the second job after causing the printing unit to begin printing of the second job; and causing, via the printing control unit, the supplying unit to supply, to the reversal unit, the continuous sheet on which the printed image of the first job has been printed.

10. The method according to claim 9, wherein the cutter unit cuts the printed continuous sheet after the printing on the first surface of the continuous sheet of the second job has been executed by the printing unit, and the supplying unit supplies, to the reversal unit, the printed continuous sheet after cutting by the cutter unit.

11. The method according to claim 9, further comprising causing, via the printing control unit, the supplying unit to discharge, to different discharge destinations, a sheet on which printing of the first job has been executed and a sheet on which printing of the second job has been executed.

12. The method according to claim 9, wherein, after completion of printing of the first job on the first surface of the continuous sheet, the method further comprising causing, via the printing control unit, the printing unit to start printing of the second job.

13. The method according to claim 9, wherein, without awaiting completion of printing of the first job on the first surface of the continuous sheet, the method further comprising causing, via the printing control unit, the printing unit to start printing of the second job.

14. The method according to claim 9, further comprising determining whether a type of continuous sheet used in the first job is same as a type of continuous sheet used in the second job, wherein, in a case where it is determined that the type of the continuous sheet used in the first job is the same as the type of the continuous sheet used in the second job, the method further comprising causing, via the printing control unit, the printing unit to begin printing of the second job subsequent to the printing of the first job and, wherein, in a case where it is determined that the type of continuous sheet used in the first job is not the same as the type of continuous sheet used in the second job, the method further comprising causing, via the printing control unit, the printing unit to wait for execution of printing of the second job until the printing on the first surface and the second surface of the continuous sheet of the first job is completed.

15. The method according to claim 14, wherein, in a case where it is determined that the type of the continuous sheet used in the first job is not the same as the type of the continuous sheet used in the printing, the method further comprising:

causing, via the printing control unit and in a case where printing of the first job for performing the two-sided printing job on the first surface of the continuous sheet is being executed by the printing unit when the instruction for the one-sided printing job of the second job is input by an input unit, the supplying unit to supply the continuous sheet on which printing of the first job has been executed to the reversal unit to the reversal unit to wait, and causing, via the printing control unit, the printing unit to begin printing of the second job.

16. The method according to claim 15, further comprising causing, via the printing control unit, the printing unit to restart printing of the first job after completion of printing of the second job.

17. A non-transitory computer-readable storage medium storing a program to cause a computer to perform a method for controlling an apparatus, wherein the apparatus includes a printing control unit and is configured to cause a printing unit to execute printing on a continuous sheet, the method comprising:

causing, via the printing control unit, the printing unit to execute, in a case where a first job is a two-sided printing job and a second job is a one-sided printing job, printing of the second job subsequent to printing of the first job on a first surface of the continuous sheet;

causing, via the printing control unit, a supplying unit to supply the printed continuous sheet to a reversal unit which reverses the continuous sheet for printing on a second surface of the continuous sheet after executing printing on the first surface of the continuous sheet; and causing, via the printing control unit, the printing unit to execute printing of the two-sided printing job on the second surface of the printed continuous sheet, wherein, in a case where the first job is a two-sided printing job and the second job is a one-sided printing job and printing on the first surface of the continuous sheet of the first job is being executed by the printing unit when an instruction for printing of the second job is input by an input unit, the method further includes:

causing, via the printing control unit, a cutter unit to cut the continuous sheet between a printed image of the first job and a printed image of the second job after causing the printing unit to begin printing of the second job; and causing, via the printing control unit, the supplying unit to supply, to the reversal unit, the continuous sheet on which the printed image of the first job has been printed.

* * * * *